United States Patent [19]

Ciuffini

[11] 3,930,853

[45] Jan. 6, 1976

[54] ACCELERATING AGING METHOD FOR SELENIUM-ARSENIC PHOTOCONDUCTORS

[75] Inventor: Anthony J. Ciuffini, Dallas, Tex.

[73] Assignee: Xerox Corporation, Stamford, Conn.

[22] Filed: Dec. 6, 1973

[21] Appl. No.: 422,502

[52] U.S. Cl. ..... 96/1.5; 96/1 R
[51] Int. Cl.[2] ..... G03G 5/04
[58] Field of Search ..... 96/1.5, 1 R

[56] References Cited

UNITED STATES PATENTS

| | | | |
|---|---|---|---|
| 2,551,582 | 5/1951 | Carlson | 96/1 R |
| 2,886,434 | 5/1959 | Owens | 96/1.5 |
| 3,533,783 | 10/1970 | Robinson | 96/1.5 |

FOREIGN PATENTS OR APPLICATIONS

| | | | |
|---|---|---|---|
| 1,909,913 | 10/1969 | Germany | 96/1.5 |

OTHER PUBLICATIONS

Electrophotography, R. M. Schaffert, 1965, p. 236.

Electrophotography, R. M. Schaffert, 1965, p. 219.

Jour. Applied Physics, Vol. 42, No. 12, Nov. 1971, J. S. Berkes et al., pp. 4908–4916.

"Aging of Vitreous Arsenic–Selenium Photoconductors", M. P. Trabisky and Meghart, Applied Optics, (suppl. 3), pp. 59–63, 1969.

*Primary Examiner*—David Klein
*Assistant Examiner*—Judson R. Hightower
*Attorney, Agent, or Firm*—James J. Ralabate; John E. Crowe; James P. O'Sullivan

[57] ABSTRACT

A method for expediting the breaking in or aging of xerographic photoreceptors comprising a substrate and at least one selenium and arsenic-containing photoconductor layers and to improve low density image differentiation by initially exposing the photoconductor layers to a visible or ultraviolet light flux while at a temperature of not less than about 85°C.

9 Claims, No Drawings

ACCELERATING AGING METHOD FOR SELENIUM-ARSENIC PHOTOCONDUCTORS

BACKGROUND OF THE INVENTION

The formation and development of images on the imaging surfaces of photoconductive materials by electrostatic means is well-known (Carlson, U.S. Pat. No. 2,297,691). The best known of the commercial processes, more commonly known as xerography, forms a latent electrostatic image on the surface of an imaging layer by uniformly electrostatically charging the surface in the dark, and then exposing the charged surface to a light and shadow image. The light-struck areas of the imaging layer are thus made substantially more charge-conductive and the electrostatic charge is selectively dissipated in such areas. After light exposure, the latent electrostatic image remaining on the imaging surface (i.e. a positive electrostatic image) is made visible by contacting with finely divided colored or black electroscopic material, known in the art as "toner". Toner is principally attracted to those areas on the image bearing surface which retain the original electrostatic charge and thereby form a visible positive image.

In structure, the conventional xerographic plate normally has a photoconductive insulating layer overlaying the conductive base or substrate and frequently an interface or charge blocking layer between the two.

The photoconductive layer may comprise a number of materials known in the art. For example, selenium-containing photoconductive material such as vitreous selenium, or selenium modified with varying amounts of arsenic are found very useful in commercial xerography. Generally speaking, the photoconductive layer should have a specific resistivity greater than about $10^{10}$ ohm-cm (preferably $10^{13}$ ohm-cm) in the absence of illumination. In addition, resistivity should drop at least several orders of magnitude in the presence of an activating energy source such as light. As a practical matter, a photoconductive layer should support an electrical potential of at least about 100 volts in the absence of light or other actinic radiation, and may usefully vary in thickness from about 10 to 200 microns.

In addition to the above, photoconductive layers will also normally exhibit some reduction in potential or voltage leak, even in the absence of an activating light. This phenomenon, known as "dark decay", will vary somewhat with the amount of usage of the photoreceptor. The existence of this problem is well-known and has been controlled, where necessary, by incorporation of an interface or barrier layer such as a very thin dielectric film or layer between the substrate and the photoconductive insulating layer. U.S. Pat. No. 2,901,348 to Dessauer et al. utilizes a layer of aluminum oxide in this manner. With some limitations, blocking interface layers can effectively function not only to permit a photoconductive layer to support a charge of relatively high field strength, and to substantially minimize dissipation (dark decay) in the absence of illumination, but also to aid in cementing the photoconductive layer to the substrate. When activated by illumination, however, the interface-photoconductor layer combination must still be sufficiently conductive to permit dissipation or discharge of a substantial portion of the applied charge through the photoconductive layer.

When the newer, more sensitive inorganic selenium alloys such as arsenic-rich selenium alloys (ref. U.S. Pat. Nos. 2,822,300, 2,802,542, and 3,312,548) are utilized as photoconductors, it is particularly important for obtaining proper charging characteristics and minimal dark decay that the photoreceptor be properly "broken in" or "aged" before regular usage.

Normally, the breaking in procedure for a photoreceptor of the selenium type can require dark storage for an extended period followed by a run of up to about a thousand test copies. For various reasons, however, the break in period must sometimes be carried out without adequate control over all of the physical parameters, such as temperature, humidity and general atmospheric contamination. Since such parameters have a substantial effect on the ultimate life and efficiency of the photoreceptor, it is very desirable that the breaking in process be of short duration and avoid as many uncontrolled variables as possible.

An equally troublesome problem with the newer, faster Se-As-type photoconductors is a tendency to sacrifice low density copy resolution in favor of speed and increased range of light sensitivity.

It is an object of the present invention to improve the operating efficiency of selenium and arsenic-containing photoreceptors of the xerographic type to obtain improved resolution from low density copies.

THE INVENTION

The above objects are obtained in accordance with the present invention by exposing the photoconductor layer of a xerographic photoreceptor comprising a substrate and at least one selenium and arsenic-containing layer to a visible or ultraviolet light flux while at a temperature of about 55°–180°C.

For this purpose, a light flux of about 4,000–7,000 Angstrom and a temperature range of about 85°–170°C. is preferred in view of the heat sensitive nature of selenium-containing xerographic photoconductors generally.

While light exposure can be effected at any phase of a separate heating step in accordance with the above-described process, it is found particularly advantageous to carry out the above-described process in a vacuum coater oven. Generally, such treatment can be carried out while a photoreceptor (i.e. drum or plate) is returning to ambient temperature and pressure following the usual evaporation-condensation step for applying one or more selenium-arsenic photoconductor layers onto a metal substrate such as an aluminum, nickel or steel drum, belt or plate. Suitable photoconductive materials and methods for applying them are listed, for instance, in U.S. Pat. Nos. 3,490,903, 3,312,548, 2,970,906, 2,901,348, 2,822,300, 2,803,542 and 2,753,278.

A particularly suitable technique for obtaining suitable photoconductor material involves sealing selenium, arsenic and a small amount of a halogen in a container under heat to form a homogeneous photoconductive material; the resulting alloy is, thereafter, condensed onto a suitable substrate by evaporation from one or more stainless steel crucibles under vacuum.

Also includible within the scope of the present inventive process are selenium and arsenic-containing photoreceptors having the usual ancillary layers such as a thin dielectric film positioned between the substrate and photoconductive layers and overcoat layers such as a protective vitreous material.

The process, as above described, is particularly effective for breaking in or aging photoreceptors having one or more photoconductor layers comprising selenium and about 5–50% by weight of arsenic.

Insofar as light intensity is concerned, it is found that the intensity of light required varies somewhat with the temperature at which the photoconductor is maintained or averaged. Generally speaking, however, an intensity of about 100–300 microwatts/cm² is preferred when cool white light is being utilized.

The above-described invention can be conveniently carried out over a period of about 15–120 minutes depending upon the temperature of the heating step and the type and intensity of light flux employed. It is also sometimes found convenient, however, to dark age the treated photoreceptor for a brief period (ex. a few days) and to run off a few hundred copies as a supplemental part of the breaking in process.

The above-described process is also not limited with respect to any particular light or heat source, although the use of a cool white visible light, as previously indicated, is a preferred embodiment.

The following examples further describe preferred embodiments of the present invention.

EXAMPLE I

Four aluminum foil test strips identified as T 1–4 are cleaned, washed and rinsed with deionized water, mounted on a rotatable mandrel and positioned in a vacuum coater above and proximate to 4 open, electrically heated stainless steel crucibles containing 10 grams of $As_2Se_3$ (40% by weight $As_2Se_3$). The strips are slowly heated up to about 85°C. and the coater evacuated to $5 \times 10^{-4}$ Torr. The crucibles are then heated up to 380°C. and the mandrel slowly rotated for about 20 minutes. The coater and its contents are then permitted to return to ambient temperature and strips T1 and T2 removed and separately heated for 1 hour at 150°C. and 170°C. respectively, in a circulating air oven while rotating slowly 25 cm. from a cool room light having an intensity of 150 microwatts/cm². After removal, the strips are dark stored for 14 hours and tested after 1,000 copies are run in a "2400" type copier; strips T3 and T4 are taken from the vacuum coater, cooled and immediately tested on the same copier without any storage or breaking in period. The results are reported in Table I below.

TABLE I

| Sample | Treatment Temp | Initial Charge (volts) | Available Contrast Potential (volts) |
|---|---|---|---|
| T1* | 150° | +750±20 | 720 |
| T2* | 170° | +750±10 | 680 |
| T3** | — | +750±65 | 620 |
| T4** | — | +750±55 | 620 |

*Inventive process
**No breaking in or aging step

EXAMPLE II

Four xerographic aluminum photoreceptor drums of the "2400" type and identified as T 5–8, are coated in the manner of Example I, T5 being then heated to 150°C. in the coater and slowly cooled to about 50°C. under Cool White Room Lights (150–200 u W/cm²), dark stored for about 14 hours and then 200 pre-test runs made before evaluation. This procedure is repeated with T6 except that the heating step is carried out at 170°C.

Drums T 7–8 are identically coated but are immediately dark stored for one month without the additional light exposure and pre-aged at 1,000 copies before evaluation of electrical properties. The test results are reported in Table II below.

TABLE II

| Sample | Post Heat Temp | Residual Pot. | Contrast Pot. | Discharge Time of Resid. Pot. (sec.) |
|---|---|---|---|---|
| T5* | 150° | 20 v | 720 v | 3 |
| T6* | 170° | 20 v | 680 v | 3 |
| T7 | — | 85 v | 620 v | >18 |
| T8 | — | 90 v | 620 v | >18 |

*Invention

Also noted with respect to the experiment reported in Example II is the fact that a major difference in the time constant of the residual potential is observed, it being significantly lower in samples exposed to a post heating step.

EXAMPLE III

Drums T5 and T7 are xerographically tested in the dynamic mode by installation in a "2400" copier machine and 200 copies made from low density originals after the initial tests were concluded (ref. Example II). After inspection of the first and last 10 copies, the results are reported in Table III below.

TABLE III

| Sample | Low Density Resolution |
|---|---|
| T5 | vg |
| T7 | g |

vg = very good
g = good

What is claimed is:

1. In a process for improving the operating efficiency and to increase low density copy resolution of a xerographic photoreceptor comprising a substrate and at least one selenium-arsenic alloy as a photoconductor layer, the improvement comprising exposing the uncharged photoconductor layer of the photoreceptor to a nonimaging visible or ultraviolet light flux while at a temperature of about 55°–180°C.

2. The process of claim 1 comprising exposing the photoconductor layer to a light flux of about 4,000–7,000 Angstrom.

3. The process of claim 2 wherein the photoconductor layer is exposed to visible white light while the photoconductor is within a temperature range of about 85°–170°C.

4. The process of claim 2 wherein at least one photoconductor layer comprising selenium and not less than about 5% be weight of arsenic is exposed to light for a period of about 15–120 minutes.

5. The process of claim 2 wherein the photoconductor layer comprises selenium and about 5–50% by weight of arsenic.

6. The process of claim 2 wherein the photoconductor layer is exposed to light at an intensity of about 100–300 microwatts/cm².

7. The process of claim 3 wherein the photoconductor layer contains selenium and about 5–50% by weight of arsenic.

8. The process of claim 3 wherein the photoconductor layer is exposed to cool white light at an intensity of about 150–200 microwatts/cm$^2$.

9. The process of claim 8 wherein the photoconductor layer is permitted to cool from about 170°C. for about 30–120 minutes in the presence of cool white light.

* * * * *